US006786980B2

(12) United States Patent
Peppler et al.

(10) Patent No.: US 6,786,980 B2
(45) Date of Patent: Sep. 7, 2004

(54) STEEL PRODUCT AND METHOD FOR MANUFACTURING

(75) Inventors: William Joseph Peppler, Pine Springs, MN (US); Brett Michael Jackson, Wilton, IA (US)

(73) Assignee: Cargill, Incorporated, Wayzata, MN (US)

( * ) Notice: Subject to any disclaimer, the term of this patent is extended or adjusted under 35 U.S.C. 154(b) by 0 days.

(21) Appl. No.: 10/096,601

(22) Filed: Mar. 12, 2002

(65) Prior Publication Data

US 2003/0173006 A1 Sep. 18, 2003

(51) Int. Cl.[7] ..... C22C 38/24; C22C 38/22; C21D 8/00

(52) U.S. Cl. ..... 148/320; 148/334; 148/663

(58) Field of Search ..... 148/334, 320, 148/663

(56) References Cited

U.S. PATENT DOCUMENTS 4,483,722 A * 11/1984 Freeman ..... 148/901
5,415,834 A * 5/1995 Finkl et al. ..... 148/335

FOREIGN PATENT DOCUMENTS

JP 49059024 A * 6/1974

* cited by examiner

*Primary Examiner*—Deborah Yee
(74) *Attorney, Agent, or Firm*—Fish & Richardson

(57) ABSTRACT

A method for providing a steel product having a surface hardness of between about 360 Bhn and 420 Bhn is provided. The method includes steps of providing a steel product from a steel product comprising at least about 96 wt. % iron and between about 0.24 wt. % and about 0.30 wt. % carbon, heating the steel product to at least its austentizing temperature, quenching to below its martinsite finish temperature, and tempering the steel product at a temperature of at least about 800° F. Steel products prepared by this method are described.

22 Claims, No Drawings

STEEL PRODUCT AND METHOD FOR MANUFACTURING

FIELD OF THE INVENTION

The present invention relates to a steel product that can be used in abrasion resistant applications and to methods for manufacturing such an abrasion resistant steel product.

BACKGROUND OF THE INVENTION

In general, the flow of materials across a steel surface has a tendency to abrade or erode the steel over time. Accordingly, the steel industry has developed specific products for these types of applications. Wear plates are one example. Wear plates are often found in conveyor systems and material handling chutes. Materials that often flow across wear plates causing the wear plates to degrade include coal, gravel, minerals, wheat, and corn. Because wear plates have a tendency to erode over time, they are often designed to be replaceable. Therefore, once a wear plate has abraded or eroded to a certain extent, it is often merely removed and replaced with a new one.

Because of the abrasive environment in which wear plates are used, industry has sought to manufacture steel with a relatively high degree of surface hardness and a relatively high degree of abrasion resistance. Unfortunately, this specialized steel, while exhibiting excellent wear characteristics, has some short comings. Often this product is brittle and cannot withstand mild bending that may be necessary for installation or use of the product. Due to the desire of end users to avoid premature breakage in service and perform mild bending of wear plates for some applications, some degree of formability is highly desirable. In addition, during the heat treatment of currently available abrasion resistant bar products, the bar product experiences varying degrees of distortion, which requires the product to be straightened. Currently available products do not have the ability to consistently withstand the mild bending required for straightening and subsequent breakage can result in significant losses in both time (extra time to straighten) and material. In many cases currently available abrasion resistant material cannot be straightened due to its relatively low ductility and is unacceptable to customers. This inability to straighten is such significant problem that wear resistant shapes have never been hot rolled and heat treated as a single piece. For this reason, wear resistant flats have often been manufactured by slitting large plates adding cost and inconvenience. The present invention provides a new abrasion resistant type steel and a process for preparing such abrasion resistant steel. The present invention or the first time provides mild formability for both the end application and manufacturing straightening process.

SUMMARY OF THE INVENTION

The present invention describes a hardened steel product comprising (i) at least about 96 wt. % iron;

(ii) between about 0.24 wt. % and about 0.30 wt. % carbon;

wherein;

(iii) the steel product has a Brinell hardness according to ASTM A370 of greater than 360 Bhn; and (iv) an elongation according to ASTM A370 of at least about 8 percent at a two inch gauge.

The hardened steel product can be, but need not be, prepared by the following process, comprising steps of:

(a) providing a steel product comprising at least about 96 wt. % iron and between about 0.20 wt. % and about 0.30 wt. % carbon;

(b) heating the steel product to at least its austentizing point;

(c) quenching the steel product to temperature below its martensite finish temperature; and (d) tempering the steel product at a temperature of at least about 850° F. to provide a hardened steel product having a surface hardness of greater than about 360 Bhn.

The present invention is the first demonstration of an abrasion resistant steel product that can withstand mild bending necessary for either straightening or for required installation manipulations. The product is manufactured by counterintuitive balance between a relatively high carbon level and a surprisingly high tempering temperature. This balance results in the hardened steel product's unique characteristics. The present invention provides the opportunity to prepare abrasion resistant shapes in a single hot rolling and subsequent heat treating process. To date these shapes must be manufactured by welding numerous pieces together. Because of the cost of this welding step, many uses of abrasion resistant shapes have not been exploited. The present invention will allow for the hot rolling, tempering, and straightening of shapes for the first time. In addition, the surprising formability of the present invention will enable the use of abrasion resistant steel in many new applications. For many users of abrasion resistant steel products the formability is an essential requirement for the steel's application.

DETAILED DESCRIPTION OF THE PREFERRED EMBODIMENT

Steel products according to the present invention can be used as wear plates in abrasion resistant applications. The steel products according to the invention can be manufactured from a steel composition where the chemistry and the heat treatment of the steel product are selected to provide a steel product with desired physical properties of surface hardness and formability.

The chemistry of the steel product that can be used to provide the steel product according to the present invention is selected to provide a desired level of surface hardness and formability when heat treated according to the invention. It is believed that heat treatment of the steel product will result in an interaction between the starting components. That is, although certain components may be chemically modified when provided in the steel product according to the invention, it should be understood that the chemistry of components is generally described by the weight percentages present in the final product, according to known methods.

It should be understood that the use of the term "about" throughout this document reflects a degree of flexibility in the value identified if the value can be adjusted while still achieving the advantages of the invention. The present invention also includes the specific ranges and values that could be identified by removing the "about" designation.

The largest component of the steel product according to the present invention is iron. The steel product includes at least about 96 wt. percent iron. It is expected that the steel product will include between about 96 wt. percent to about 98 wt. percent iron, and can include between about 96.5 wt. percent and about 97.5 wt. percent iron.

The steel product includes a sufficient amount of carbon to provide the steel product with the desired surface hardness. The skilled artisan would appreciate that too high a carbon level will create the potential for quench crack formation during the quench step of the present process. The level of carbon preferred in the present invention is between about 0.20 wt. percent and about 0.30 wt percent. More preferably the carbon is present in an amount between about 0.24 wt. percent and about 0.30 wt. percent and most preferably between about 0.26 wt. percent and about 0.29 wt. percent.

The steel product can include a sufficient amount of manganese to provide desired surface hardenability and strength. If too little manganese is used, the steel product may not achieve the hardness and strength benefits of the manganese, and similar to the percentage carbon too much manganese may result in a greater chance for stress crack formation during the quench step according to the invention. The steel product preferably includes between about 0.6 wt. percent and about 1.65 wt. percent manganese, and more preferably, between about 1.25 wt. percent and about 1.45 wt. percent manganese.

Chrome can be provided in the steel product for increasing the hardenability of the steel product. In general, if too little chrome is added, the benefits of chrome may not be realized, and adding too much chrome may increase costs to an unacceptable level. The steel product preferably includes between about 0.35 and about 1.00 wt. percent chrome and more preferably includes between about 0.5 wt. percent and about 0.7 wt. percent chrome.

Vanadium can be provided in the steel product for increasing the hardenability property of the steel product. In general, if too little vanadium is provided, the steel product may not achieve the benefits of the vanadium. If too much vanadium is provided in the steel product, the steel product may exhibit an undesired level of tempering resistance. That is, it may be more difficult and costly to temper the steel product to achieve the desired physical properties if there is too much vanadium. The steel product preferably includes between about 0.02 wt. percent and about 0.10 wt. percent vanadium and more preferably includes between about 0.025 wt. percent and 0.045 wt. percent.

The steel product can include molybdenum to assist the steel product in obtaining a desired heat treatment response over a wide temperature range. It is expected that the molybdenum stabilizes carbides as they are formed within the product. In general, it is expected that too little molybdenum in the steel product will result in the steel product not obtaining the benefits of the molybdenum, and too much molybdenum will increase costs to an unacceptable level. The steel product preferably includes between about 0.15 wt. percent about 0.30 wt. percent molybdenum and more preferably includes about 0.15 wt. percent about 0.25 wt. percent molybdenum.

The steel product may be obtained from scrap steel but need not be. As a result, there is likely to be a level of residual components or "residuals" that are present within the scrap steel. Residuals commonly found in scrap steel include copper, nickel, and tin. In general, the residuals are those components that are inherently present in the steel product and that do not significantly contribute to surface hardness or formability of the steel product. It is expected that the amount of residuals, if they are present at all, are present in an amount of less than about 1 wt. percent. In many applications, it is expected that the amount of nickel, if present at all, will be present in an amount of less than about 0.25 wt. percent, the amount of copper, if presently at all, will be present an amount of less than about 0.35 wt. percent, and the amount of tin, if present at all, will be present in an amount of less than about 0.04 wt. percent.

The term "bars" as used herein refers to class of well recognized steel products, including but not limited to flats and shapes. The dimensions of bars according to the invention can be provided at any desired values. It is expected that for most applications according to the invention, the bars will have a thickness within the range of about ¼ inch and about 2 inches. In addition, the thickness of the bars can be provided between about ½ inch and about 1 inch. The length of bars according to the present invention can be provided at any convenient or desired length.

In general, the industry refers to bars as either "shapes" or "flats" depending upon the configuration of the bars. Flats are generally considered to be relatively flat sheets or boards. Flats can be formed into particular dimensions for use in particular applications, and flats can be hot rolled or cut from relatively large sheets to provide the desired dimensions. It is expected that for many applications according to the invention, flats can have a size ranging from about 1 inch to about 14 inches wide and between about ¼ inch and about 2 inches thick. Products that are not considered flats are often referred to as shapes.

The term "shapes" as used herein refers to products including but not limited to rounds, squares, angles, channels, and the like. In general, shapes refer to any configuration that is not able to manufactured by slitting from a larger sheet of steel but rather are rolled into the shape as a single unit. Shapes such as angles and channels can be provided with varying dimensions based upon their intended use.

The term "steel product" as used herein refers to a steel composition that has been processed into a desired configuration. Wear plates can be formed from steel products according to the invention and can have practically any configuration and can be used in any situation where increased wear resistance is desired. Exemplary applications for wear plates include conveyor systems and material handling chutes.

The steel product is heat treated according to the invention to provide the "hardened steel product" with desired physical properties. The heat treating process includes a step of hardening and a step of tempering. The hardening step is provided in order to generate a desired level of surface hardness and a desired level of abrasion resistance in the final product. It is expected that a desired level of abrasion resistance will result from a steel product having a desired level of surface hardness. The tempering step is intended to increase the formability or ductility of the steel product so that it is not too brittle.

The step of hardening the steel product generally involves steps of heating the steel product to a sufficient temperature for a sufficient length of time to cause austenitite structure formation and then quenching the product. The skilled artisan will appreciate that generation of austenitite structure involves heating the steel product to an austenitizing temperature sufficient to generate austentite structures in the product. It is expected that the step of heating will involve heating the shaped steel in a furnace having a temperature of at least 1,500° F. The skilled artisan would also appreciate that the length of time the steel product will be held at this temperature will depend on depend on the thickness or shape of the product and the type of furnace used.

For steel product having a thickness of between about ¼ inch and about 2 inches, it is expected that the product will be held in the furnace between about 15 minutes and about 2 hours, if a typical gas furnace is utilized. A steel product having a thickness of about ¼ inch to 1 inch will typically be heated for between about 15 minutes and about 80 minutes, and a steel product having a thickness of about 1 inch to about 2 inches will typically be heated for between about 80 minutes and about 2 hours, in a typical gas furnace. The skilled artisan would appreciate that elevating the furnace temperature will reduce the time necessary to fully austenitize the product. Therefore temperatures such as 1650° F., 1700° F., or even 1750° F., or higher would also function in the present invention. This increase in temperature may accelerate the rate of austenitite structure formation, but it is expected that increasing the furnace temperature too much may unnecessarily increase the overall cost of the process. The type of furnace utilized for this step or the duration of the heating are not crucial to the present invention so long as the product reaches the austenitizing point and a variety of furnace types could be used. It is anticipated that during the heating step the temperature of the steel product will approach or become equivalent to the furnace temperature therefore the steel product itself will reach 1500° F., 1650° F., 1700° F., or even 1750° F. Of course the reasonably skilled artisan will appreciate that the temperature of the product and the furnace temperature are not crucial. The only essential point is that the steel product reaches the austenitizing temperature.

The step of quenching during the hardening step is provided for rapidly decreasing the temperature of the now heated steel product. It is understood that the step of quenching causes the steel to undergo a change in structure to form martensite structures. Quenching is complete when the product has been cooled to below the martensite finish temperature. The martensite finish temperature can be calculated by skilled artisan using known methods and depends principally on the chemistry of the steel product. The step of quenching can include applying a cooling media to the hot steel product by spray or by bath. Exemplary media include water, salt water, water/synthetic quench combinations, and oil. A typical technique for quickly reducing the temperature of the steel product is by application of a water spray in a spray quench line. Alternatively, baths of water, water/synthetic quench combinations, or oil can be used when it is desirable to provide a less severe quench compared with a spray quench line.

The step of tempering is performed by heating the hardened steel product to a temperature of at least 800° F. and for a sufficient amount of time to allow the microstructure within the hardened steel to relax to a certain extent to provide a desired level of formability while retaining a desired level of surface hardness. The tempering step is preferably performed at a temperature of between about 850° F. and about 1,100° F. It is well known that the length of time the steel product is exposed to the tempering temperature may depend on the thickness of the steel product and the type of furnace used. If the steel product is exposed to the tempering temperature for too long, it is expected that the steel product may lose too much surface hardness. Tempering times in a conventional gas furnace range from 15 minutes to 2 hours but preferably are between 30 minutes and 1 hour. Tempering times in an induction furnace or infrared furnace may be greatly reduced. The tempering time or method is not a crucial element of the invention. It is only essential that the tempering be managed to allow for the final product to have elongation greater than 8 percent and a hardness of greater than 360 Bhn.

The steel products according to the present invention can be hardened and tempered to achieve desired properties of hardness and elongation or formability. Surface hardness characterized as a Brinell hardness and elongation (percentage) can be relied upon for characterizing steel products that can be prepared according to the invention. The surface hardness provided will typically be greater than 360 Bhn and preferably be in a range of between about 360 Bhn and about 440 Bhn, and more preferably will be provided within the range of about 380 Bhn and about 420 Bhn. The elongation of the steel products of the present invention will preferably be at least 8 percent, and more preferably 12, or even 16 percent.

EXAMPLES

Steel products having the chemistry identified in Table 1 were hardened and tempered according to the temperatures and times reported in Table 2. Properties of hardness and elongation in a 2 inch gauge length are reported in Table 2. The chemistry identified in Table 1 identifies the weight percent of each of the identified components. The substantial balance of each product is iron. The steel products identified in Tables 1 and 2 are provided as flats having the thickness identified in Table 2.

TABLE 1

| Ex | C | Mn | Cu | Ni | Mo | Cr | V |
|---|---|---|---|---|---|---|---|
| 1 | 0.27 | 1.27 | 0.16 | 0.08 | 0.15 | 0.63 | 0.031 |
| 2 | 0.27 | 1.27 | 0.16 | 0.08 | 0.15 | 0.63 | 0.031 |
| 3 | 0.28 | 1.34 | 0.14 | 0.08 | 0.19 | 0.63 | 0.031 |
| 4 | 0.28 | 1.34 | 0.14 | 0.08 | 0.19 | 0.63 | 0.031 |
| 5 | 0.28 | 1.34 | 0.14 | 0.08 | 0.19 | 0.63 | 0.031 |
| 6 | 0.27 | 1.27 | 0.16 | 0.08 | 0.15 | 0.63 | 0.031 |
| 7 | 0.27 | 1.27 | 0.16 | 0.08 | 0.15 | 0.63 | 0.031 |
| 8 | 0.28 | 1.34 | 0.14 | 0.08 | 0.19 | 0.63 | 0.031 |
| 9 | 0.26 | 1.32 | 0.12 | 0.06 | 0.18 | 0.56 | 0.029 |
| 10 | 0.28 | 1.20 | 0.26 | 0.14 | 0.18 | 0.56 | 0.035 |
| 11 | 0.28 | 1.20 | 0.26 | 0.14 | 0.18 | 0.56 | 0.035 |
| 12 | 0.27 | 1.29 | 0.12 | 0.05 | 0.18 | 0.54 | 0.031 |
| 13 | 0.27 | 1.29 | 0.12 | 0.05 | 0.18 | 0.54 | 0.031 |
| 14 | 0.26 | 1.32 | 0.12 | 0.06 | 0.18 | 0.56 | 0.03 |
| 15 | 0.28 | 1.33 | 0.25 | 0.09 | 0.19 | 0.54 | 0.03 |
| 16 | 0.30 | 1.28 | 0.18 | 0.07 | 0.19 | 0.59 | 0.03 |
| 17 | 0.27 | 1.35 | 0.25 | 0.12 | 0.21 | 0.59 | 0.03 |
| 18 | 0.27 | 1.33 | 0.31 | 0.14 | 0.18 | 0.56 | 0.03 |
| 19 | 0.27 | 1.33 | 0.31 | 0.14 | 0.18 | 0.56 | 0.03 |

TABLE 2

| Ex. | Thickness (inch) | Hardness (Bhn) | Elongation (percent) | Hardening Temp. (° F.) | Hardening Time (minutes) | Temp. T (° F.) | Temp. Time (mins) |
|---|---|---|---|---|---|---|---|
| 1 | 1.000 | 360 | 16 | 1575 | 39 | 850 | 39 |
| 2 | 1.000 | 360 | 13 | 1575 | 39 | 850 | 39 |
| 3 | 1.000 | 364 | 10 | 1575 | 15 | 850 | 19 |
| 4 | 1.000 | 364 | 9 | 1575 | 15 | 850 | 19 |

TABLE 2-continued

| Ex. | Thickness (inch) | Hardness (Bhn) | Elongation (percent) | Hardening Temp. (° F.) | Hardening Time (minutes) | Temp. T (° F.) | Temp. Time (mins) |
|---|---|---|---|---|---|---|---|
| 5 | 1.000 | 364 | 9 | 1575 | 15 | 850 | 19 |
| 6 | 1.000 | 418 | 7 | 1550 | 35 | 850 | 40 |
| 7 | 1.000 | 418 | 10 | 1550 | 35 | 850 | 40 |
| 8 | 0.250 | 364 | 9 | 1575 | 15 | 850 | 19 |
| 9 | 0.250 | 364 | 9 | 1575 | 15 | 850 | 19 |
| 10 | 0.250 | 387 | 11 | 1575 | 15 | 850 | 19 |
| 11 | 0.250 | 387 | 11 | 1575 | 15 | 850 | 19 |
| 12 | 0.250 | 387 | 11 | 1575 | 15 | 850 | 19 |
| 13 | 0.250 | 387 | 11 | 1575 | 15 | 850 | 19 |
| 14 | 0.500 | 375 | | 1575 | | 900 | |
| 15 | 0.250 | 364 | | 1575 | | 900 | |
| 16 | 0.500 | 364 | | 1575 | | 900 | |
| 17 | 1.000 | 364 | | 1575 | | 900 | |
| 18 | 1.000 | 375 | | 1575 | | 900 | |
| 19 | 0.250 | 364 | | 1575 | | 900 | |

Tensile strength was determined according to ASTM A370.

Hardness in Brinell was determined according to ASTM A370. In general, Brinell hardness reflects a Brinell indentation diameter range of 0.3 mm at a specified location (2.9–3.2 would be indicate a Brinell hardness of 360–440).

Elongation was determined according to ASTM A370 in a two inch gauge length.

The steel products were initially heated in a gas fired roller hearth furnace. The steel products were quenched by spray quench using water at 85° F. to 130° F. to achieve a surface temperature of less than 130° F. The step of tempering occurred in a gas fired roller hearth furnace.

The above specification, examples and data provide a complete description of the manufacture and use of the product of the invention. Since many embodiments of the invention can be made without departing from the spirit and scope of the invention, the invention resides in the claims hereinafter appended.

What is claimed is:

1. A method comprising steps of:

(a) providing a steel product comprising at least about 96 wt. % iron between about 0.20 wt. % and about 0.30 wt. % carbon, and nickel, if present at all, no greater than 0.25 wt. %

(b) heating the steel product to at least its austentizing point;

(c) quenching the steel product to temperature below its martensite finish temperature; and (d) tempering the steel product at a temperature of at least about 8500° F. to provide a hardened steel product having a surface hardness of greater than about 360 Bhn.

2. A method according to claim 1, wherein the steel product comprises between about 0.24 wt. percent and about 0.30 wt. percent carbon.

3. A method according to claim 1, wherein the steel product comprises between about 0.26 wt. percent and about 0.29 wt. percent carbon.

4. A method according to claim 3, wherein step (b) comprises heating the steel product to a temperature of between about 1,500° F. and about 1,750° F.

5. A method according to claim 3, wherein the steel product has a cross-section of between about ¼ inch and 2 inches.

6. A method according to claim 5, wherein the steel product has a cross section of between about ¼ inch and about 1 inch.

7. A method according to claim 1, wherein the steel product is selected from the group consisting of: flats, rounds, squares, angles, and channels.

8. A method according to claim 3, wherein the steel product is provided in the form of a flat having a width of between about 1 inch and about 14 inches and a thickness of between about ¼ inch and about 2 inches.

9. A method according to claim 1, wherein step (d) comprises heating the steel product to a temperature of between about 800° F. and about 1,300° F.

10. A method according to claim 3, wherein step (d) comprises heating the steel product to a temperature of between about 850° F. and about 1,000°.

11. A method according to claim 1, wherein the steel product further comprises:

(i) between about 0.60 wt. % and about 1.65 wt. % manganese;

(ii) between about 0.35 wt. % and about 1.00 wt. % chrome;

(iii) between about 0.02 wt. % and about 0.10 wt. % vanadium;

(iv) between about 0.15 wt. % and about 0.30 wt. % molybdenum; and (v) less than about 1 wt. % residuals which, if present at all, include at least one of copper, nickel, and tin.

12. A method according to claim 11, wherein the steel product further comprises:

(i) between about 1.25 wt. % and about 1.45 wt. % manganese;

(ii) between about 0.50 wt. % and about 0.70 wt. % chrome;

(iii) between about 0.025 wt. % and about 0.045 wt. % vanadium;

(iv) between about 0.15 wt. % and about 0.25 wt. % molybdenum; and (v) less than about 1 wt. % residuals which, if present at all, include at least one of copper, nickel, and tin.

13. A method according to claim 3, wherein the hardened steel product has an elongation according to ASTM A370 of at least 8 percent at a 2 inch gauge.

14. A method according to claim 3, wherein the hardened steel product has an elongation according to ASTM A370 of at least 10 percent at a 2 inch gauge.

15. A method according to claim 3, wherein the hardened steel product has an elongation according to ASTM A370 of at least 16 percent at a 2 inch gauge.

16. A steel product comprising:

(i) at least about 96 wt. % iron;

(ii) between about 0.24 wt. % and about 0.30 wt. % carbon;

(iii) nickel, if present at all, less than 0.25 wt. %; wherein (iv) the steel product has a Brinell hardness according to ASTM A370 of greater than 360 Bhn; and (v) an elongation according to ASTM A 370 of at least about 8 percent at a two inch gauge.

17. A steel product according to claim 16, wherein the steel product comprises between about 0.26 wt. % and about 0.29 wt. % carbon and has a Brinell hardness of greater than 380 Bhn.

18. A steel product according to claim 16, wherein the steel product further comprises:

(i) between about 0.6 wt. % and about 1.65 wt. % manganese;

(ii) between about 0.45 wt. % and about 0.75 wt. % chrome;

(iii) between about 0.02 wt. % and about 0.05 wt. % vanadium;

(iv) between about 0.15 wt. % and about 0.28 wt. % molybdenum; and (v) less than about 1 wt. % residuals which, if present at all, include at least one of copper, nickel, and tin.

19. A steel product according to claim 16, wherein the steel product has a thickness of between about ¼ inch and about 2 inches.

20. A steel product according to claim 16, wherein the steel product has an elongation according to ASTM A370 of at least about 8 percent.

21. A steel product according to claim 16, wherein the steel product has an elongation according to ASTM A370 of at least about 12 percent.

22. A steel product according to claim 16, wherein the steel product has an elongation according to ASTM A370 of at least about 16 percent.

* * * * *